US005610362A

United States Patent [19]

Bouvard

[11] Patent Number: 5,610,362

[45] Date of Patent: Mar. 11, 1997

[54] AMMUNITION FEED DEVICE AND METHOD

[75] Inventor: Franck Bouvard, Bourges, France

[73] Assignee: Giat Industries, Versailles, France

[21] Appl. No.: 445,194

[22] Filed: May 23, 1995

[30] Foreign Application Priority Data

May 25, 1994 [FR] France ..... 94 06306

[51] Int. Cl.[6] ..... F41A 9/00; F41A 9/61

[52] U.S. Cl. ..... 89/33.1; 89/33.17; 89/33.03; 42/39.5

[58] Field of Search ..... 89/33.17, 33.1, 89/33.03; 42/39.5

[56] References Cited

U.S. PATENT DOCUMENTS

| | | | |
|---|---|---|---|
| 3,997,994 | 12/1976 | Kastner et al. | 42/9 |
| 4,004,363 | 1/1977 | Sackenreuter et al. | 42/9 |
| 4,348,941 | 9/1982 | Ketterer et al. | 89/155 |
| 4,669,355 | 6/1987 | Schmid et al. | 89/33.1 |
| 4,791,851 | 12/1988 | Stoner | 89/156 |
| 4,825,743 | 5/1989 | Balsavage et al. | 89/33.1 |
| 4,993,312 | 2/1991 | Achterholt | 89/155 |
| 5,429,033 | 7/1995 | Gyre et al. | 89/47 |

FOREIGN PATENT DOCUMENTS

| | | |
|---|---|---|
| 2257887 | 1/1974 | France . |
| 2419185 | 10/1975 | Germany . |
| 1461751 | 1/1977 | United Kingdom . |

*Primary Examiner*—J. Woodrow Eldred
*Attorney, Agent, or Firm*—Oliff & Berridge

[57] ABSTRACT

A mechanism for feeding ammunition in a small arm includes a linkage, a rotating member and a magazine follower. The small arm includes a barrel, a breech that moves under recoil and a magazine that extends approximately parallel to the barrel. The linkage is connected to the breech and moveable to transport the round from the magazine in a direction parallel to a longitudinal axis of the round and approximately perpendicular to the axis of the barrel. The rotating member is connected to the linkage and rotates the round by approximately by 90° such that the round is substantially aligned with the axis of the barrel. The magazine follower is shaped to receive the round and to rotate with and translate along the rotating member to insert at least a portion of the round in the barrel.

20 Claims, 5 Drawing Sheets

AMMUNITION FEED DEVICE AND METHOD

BACKGROUND OF THE INVENTION

The present invention relates to an ammunition feed device for automatic small arms, in which the feed is controlled by the counter-recoil of the breech and the magazine enclosing the ammunition extends in parallel to the axis of the barrel of the weapon, the rounds being placed in perpendicular to and underneath the afore-mentioned axis.

The invention is notably aimed at an ammunition feed device for so-called "fragile" ammunition such as caseless ammunition.

In most small arms, the feed phase is carried out upon the counter-recoil of the breech. The latter drives the round from its presentation position (roughly parallel to the axis of the barrel) to the gun chamber by pushing (impacting) on the base of the round.

Caseless ammunition is too fragile for such a feed system. A suitable feed device must therefore be envisaged which enables the transfer of the round while minimizing the strain to which it is subjected.

Moreover, this feed device must enable the transfer of a round from a longitudinal magazine placed along the axis of the barrel, the round being presented in perpendicular to the axis of the barrel.

This choice exploits the advantages which small arms present in that it enables large-capacity magazines to be integrated (increasing the infantryman's stock of ammunition) without modifying the compactness of the arm.

SUMMARY OF THE INVENTION

According to the invention, the ammunition feed device notably of the afore-mentioned type is characterised in that it comprises a mechanism which works in conjunction with the movement of the breech comprising two levers controlled by the recoil of the breech and enabling:

- during a first phase, a magazine follower to be moved in perpendicular to the axis of the barrel in order to take the round located at an end of the magazine and introduce it at the same time into a guiding mechanism which guides the movement of the round.
- during a second phase, the said magazine follower and guiding mechanism to be rotated by 90° in order to place the round in the axis of the barrel,
- during a third phase, the magazine follower to be moved towards the barrel in order to introduce the round into the latter freeing it at the same time from the guiding mechanism.

The feed device thus enables rounds to be taken from the magazine, during recoil of the breech, from their perpendicular position to the barrel, by lifting them, then rotating them by 90° in order to present them opposite the barrel and lastly pushing them successively into the barrel.

No impact is applied to the rounds at any time throughout these operations, such that the rounds do not run the risk of being damaged and the automatic functioning of the arm does not risk being prejudiced.

According to an advantageous version of the invention, the breech comprises, on one of its sides, a groove in which a finger integral with part of the feed mechanism is engaged, this groove comprises a first part extending from the rear of the breech in parallel to the direction of movement of the breech, a second part forming a rising ramp and a third part extending in parallel to the direction of movement of the breech towards the front of the latter.

This groove successively controls the rise of the magazine follower in perpendicular to the direction of movement of the breech, the rotation of 90° of the magazine follower and of the guiding mechanism, then the movement of the magazine follower in the direction of the barrel.

According to one particularity of the invention, the said finger is carried by the end of a first lever connected swivelling to an immobile part of the arm, the other end of this lever being connected in a jointed manner to a second lever which is connected swivel on the one hand to an organ mounted in rotation in part of the arm, the said organ comprising a guiding mechanism to position and transport the round, on the other hand the lever is hinged to the magazine follower.

The said organ is preferably mounted, in rotation in an indentation formed in the feeder box of the arm.

According to another particularity of the invention, the said organ is a flat part of a roughly circular shape, guided in rotation in an indentation having a matching shape.

The said organ preferably comprises, on one of its faces, a groove in which the magazine follower is engaged. This groove enables the sliding of the magazine follower to be controlled.

The said organ preferably also carries a guiding mechanism having an ammunition chute to receive a round and extending in parallel to the groove in which the magazine follower is engaged.

According to another particularity of the invention, the magazine follower comprises a rectilinear part engaged in the groove of the said organ able to slide in the latter, this rectilinear part comprises, on its lower end, a heel extending towards the chute carried by the said organ, the said heel being able to engage under a round in order to move it in the chute of the said organ during the lifting of the said magazine follower.

Other particularities and advantages of the invention will become apparent from the description given hereafter.

BRIEF DESCRIPTION OF THE DRAWINGS

In the appended drawings given by way of a non-exhaustive illustration.

DETAILED DESCRIPTION OF PREFERRED EMBODIMENTS

Figure 1:
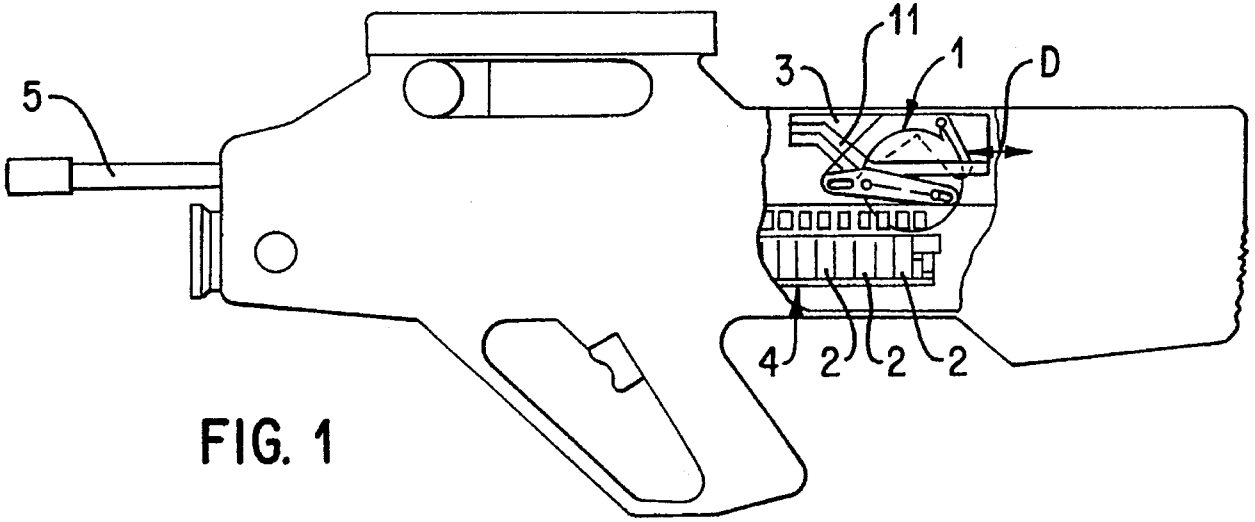
FIG. 1 is a top view, partly cut away, of an automatic small arm, comprising an ammunition feed device according to the invention.
Figure 2:
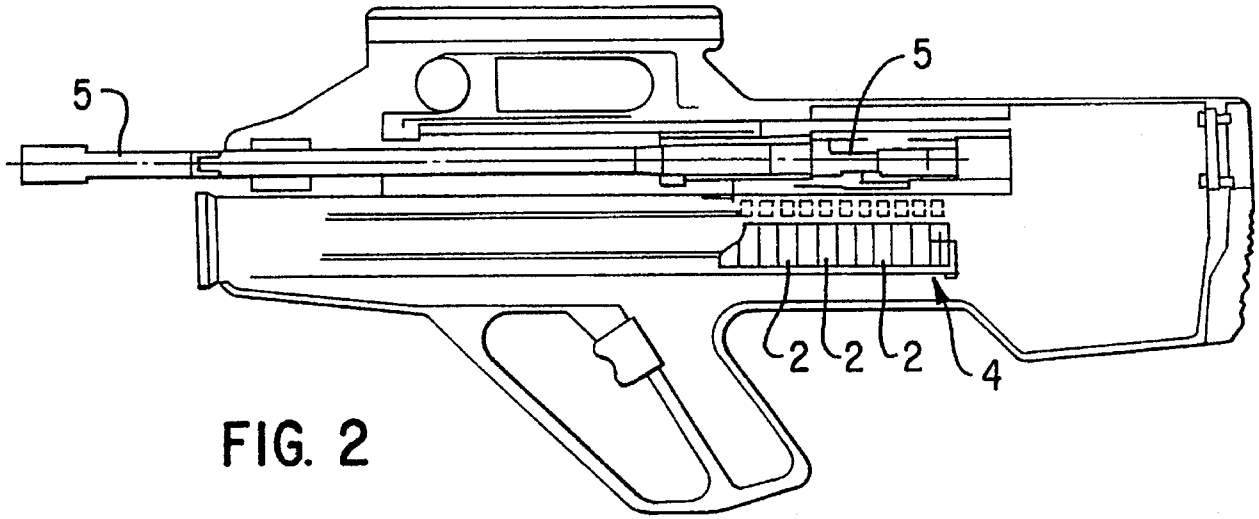
FIG. 2 is a partial longitudinal cross-section of the arm if FIG. 1, showing other particularities or the arm.

FIGS. 1 and 2 show an automatic small arm, in which an ammunition feed device 1 controlled by the counter-recoil of a breech 3 as well as a magazine 4 enclosing the ammunition which extends in parallel to the axis of a barrel 5 of the weapon have been integrated. Rounds 2 are positioned in perpendicular and underneath the axis of the barrel.

With reference to FIGS. 3 to 10, the feed device 1 comprises a mechanism 6, 7, 8, 9 working together with the movement of the breech 3 and comprising two levers 6 and 7 controlled by the recoil of the breech 3 and enabling:

during a first phase, a magazine follower 8 to be moved in perpendicular to the axis of the barrel 5 in order to take the round 2 located at an end of the magazine 4 and introduce it at the same time into a guiding mechanism 10 which guides the movement of the round 2.

during a second phase, the said magazine follower 8 and guiding mechanism 10 to be rotated by 90° in order to place the round 2 in the axis of the barrel 5, during a third phase, the magazine follower 8 to be moved towards the barrel 5 in order to introduce the round 2 into the latter freeing it at the same time from the guiding mechanism 10.

Figure 4:
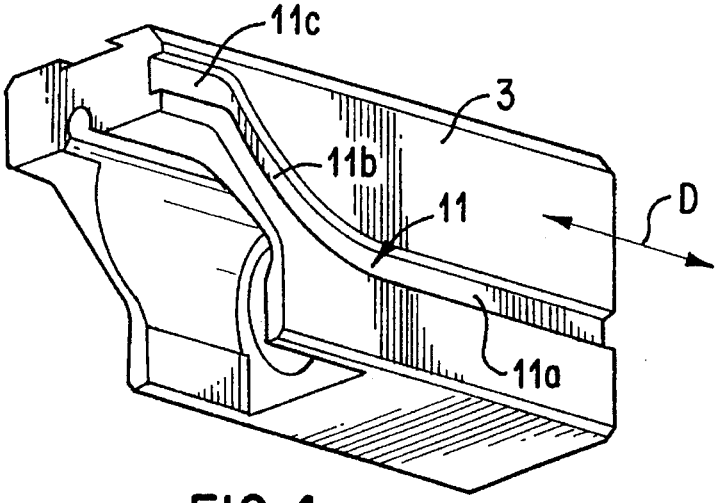
FIG. 4 shows the breech.

As may be seen from FIG. 4, the breech 3 comprises on one of its sides a groove 11 in which a finger 12 integral (i.e., formed as a single piece) with the lever 6 of the feed mechanism is engaged. This groove 11 comprises a first part 11*a* extending from the rear of the breech in parallel to the direction of movement D of the breech 3, a second part 11*b* forming a rising ramp and a third part 11*c* extending in parallel to the direction of movement D of the breech 3 towards the front of the latter.

Figure 3:
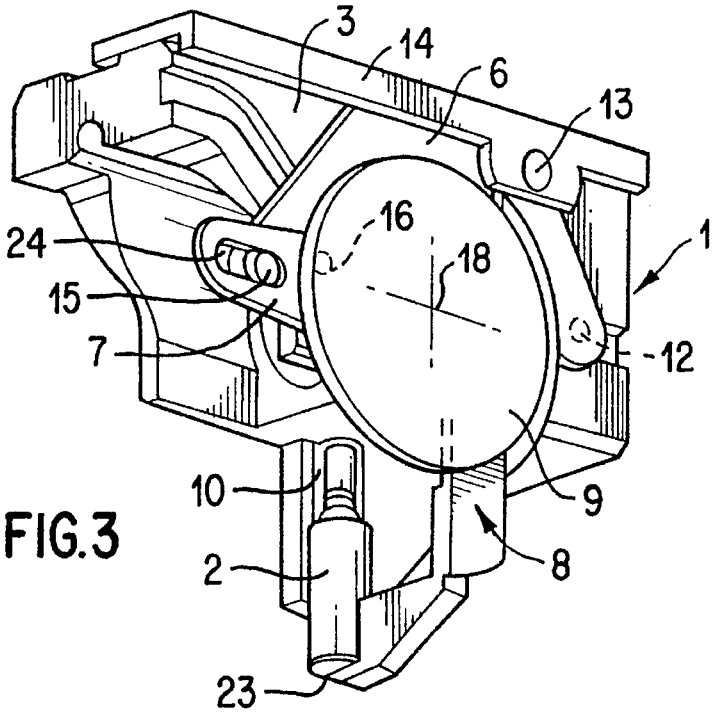
FIG. 3 is a perspective view of the feed device assembly according to the invention.
Figure 5:
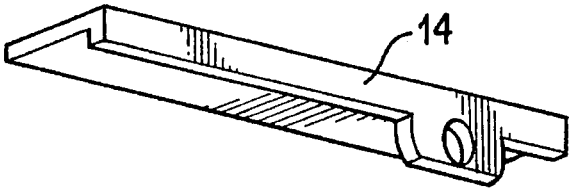
FIG. 5 shows part of the feeder box of the arm.
Figure 6:
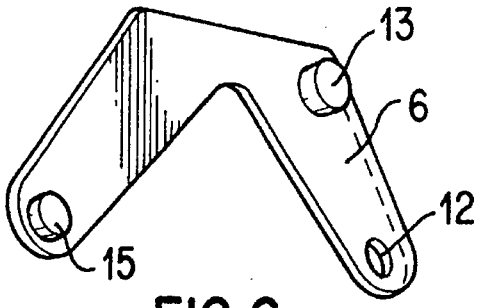
FIG. 6 shows the first lever.
Figure 7:
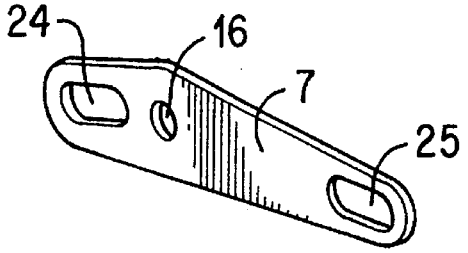
FIG. 7 shows the second lever.

As may be seen from FIGS. 3 and 5, the finger 12 is carried by the end of a first lever 6 connected to swivel about a point 13 to an immobile part of the arm constituted of the feeder box 14 of the arm (see FIGS. 3 and 5). The other end of this lever 6 being connected in a jointed manner at a point 15 to a second lever 7 which is connected to swivel about a point 16 on the one hand to an organ 9 mounted in rotation along the axis 18 in the feeder box of the arm.

The organ 9, hereafter called the transport-guiding mechanism, comprises a guiding mechanism 10 (i.e., a chute) to position and transport the round 2.

Figure 11:
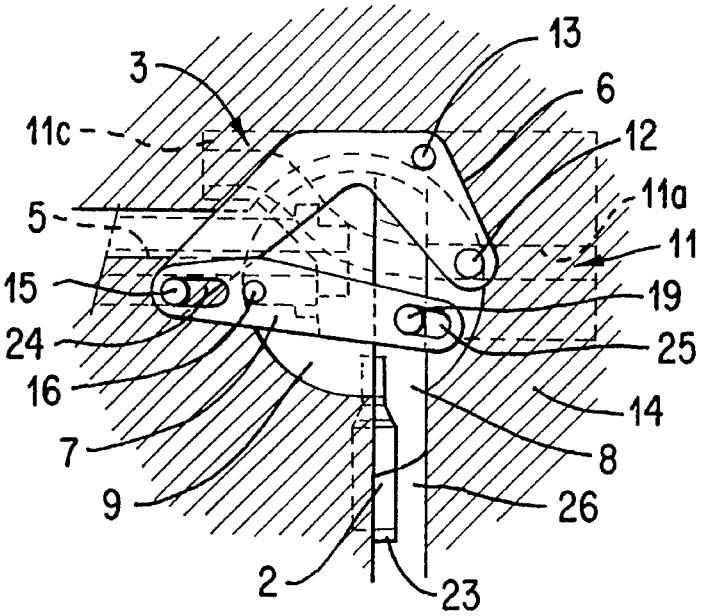
FIG. 11 is a diagrammatic view showing the starting position of the feed device.
Figure 12:
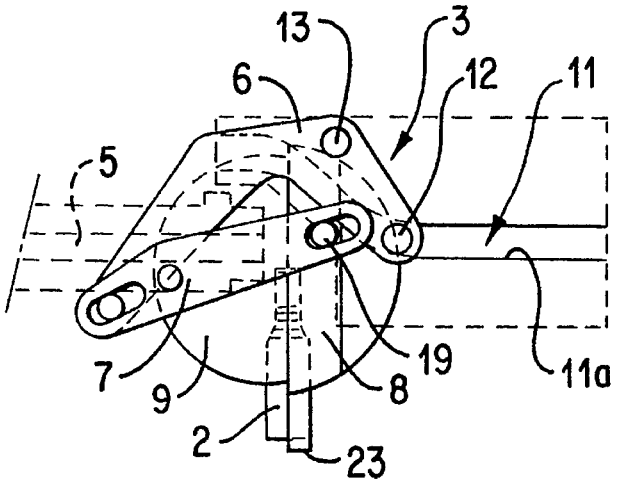
FIG. 12 is a diagrammatic view showing the first phase of vertical translation of the round.
Figure 13:
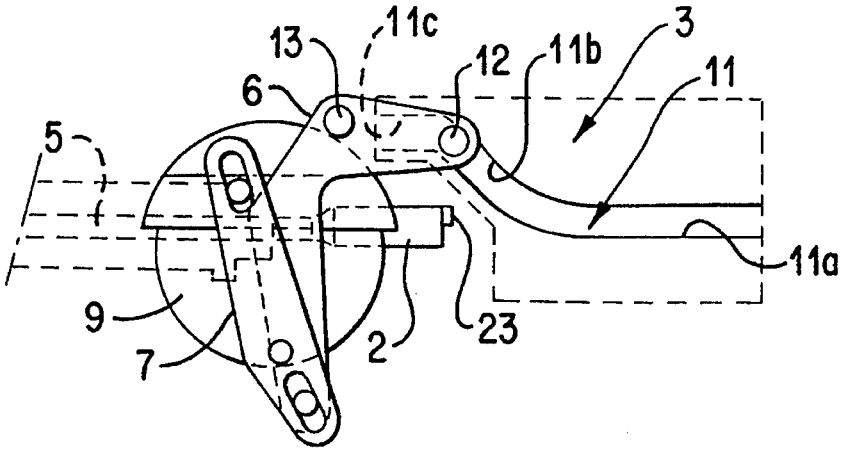
FIG. 13 shows the rotation by 90° of the round.
Figure 14:
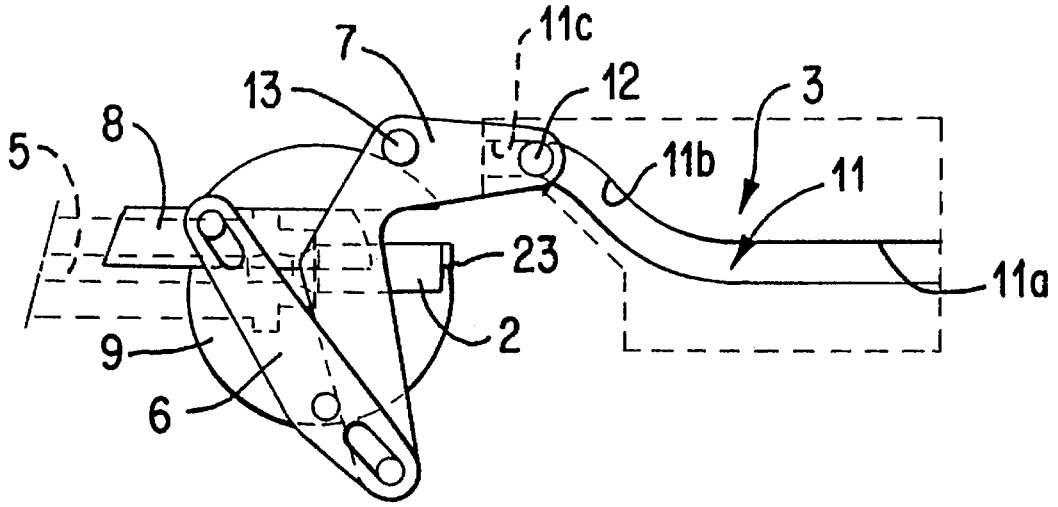
FIG. 14 shows the final phase of horizontal translation of the round.

The lever 7 is also connected in a jointed manner at a point 19 (see FIG. 11) to the magazine follower 8 of the round 2.

Figure 15:
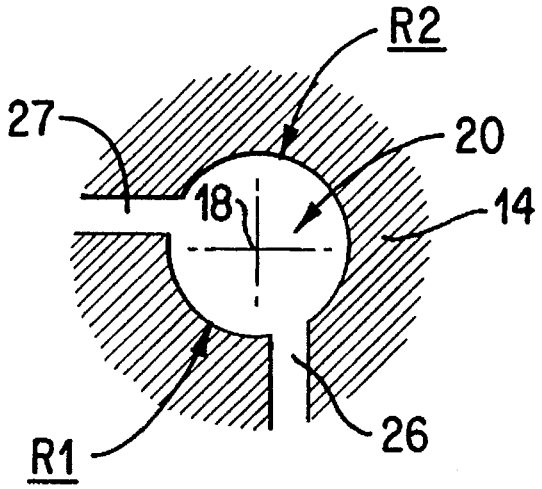
FIG. 15 is a top view of the indentation made in the feeder box to guide the rotation of the transport-guiding mechanism and the translation of the magazine follower.

The transport-guiding mechanism 9 is mounted in rotation in an indentation 20 formed in a feeder box 14 of the arm, as shown in FIG. 15.

As may be seen in FIGS. 3 to 8, the transport-guiding mechanism 9 is a flat part of a roughly circular shape, guided in rotation in the indentation 20 shown in FIG. 15 which has a matching shape.

The transport-guiding mechanism 9 comprises, on one of its faces, a groove 21 (see FIG. 8), in which the magazine follower 8 is engaged.

Figure 8:
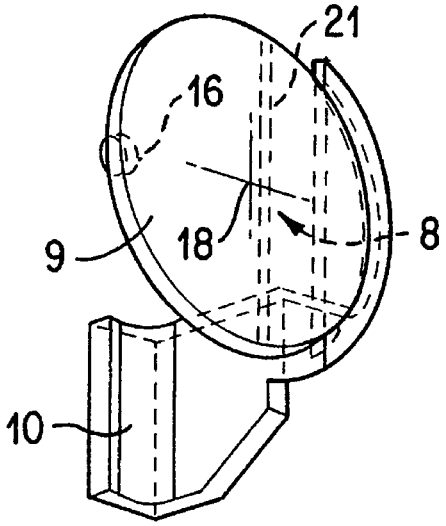
FIG. 8 shows the transport-guiding mechanism.
Figure 9:
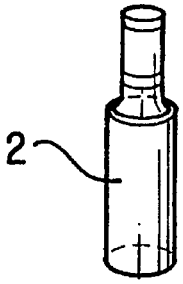
FIG. 9 shows a round.
Figure 10:
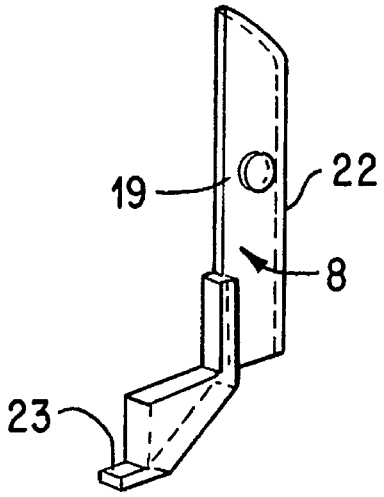
FIG. 10 shows the magazine follower.

As shown, notably in FIGS. 8 and 10, the transport-guiding mechanism 9 comprises a rectilinear part 22 engaged in the groove 21 of the transport-guiding mechanism 9 and able to slide in the latter. This rectilinear part 22 comprises, on its lower end, a heel 23 extending towards the chute 10 carried by the transport-guiding mechanism 9.

As shown in FIG. 3, the heel 23 of the transport-guiding mechanism is able to engage under a round 2 in order to move it in the chute 10 during the lifting of the magazine follower 8.

In its starting position (see FIG. 11) the first lever 6 extends above the second lever 7. This lever 6 has a roughly arched shape. The second lever 7 is more or less straight.

The first lever 6 is connected to the second lever 7 and the latter is connected to the magazine follower 8 by pivots 15, 19 engaged in the grooves 24, 25 enabling a certain translation in the direction of the elongation of the second lever 7.

In addition, a stop is provided to block the transport-guiding mechanism 9 carrying the chute 10 in rotation during the initial lifting phase of the magazine follower 8 and a second stop is provided to block the afore-mentioned transport-guiding mechanism in rotation, once the latter has rotated by 90° from its starting position (shown on FIG. 11) during the movement phase of the magazine follower 8 towards the barrel 5.

The afore-mentioned stops are formed in the indentation 20 arranged in the feeder box 14 of the arm.

As shown in FIG. 15, the indentation 20 comprises a roughly circular part but has two radii R1, R2 which are slightly different, in which the rotating transport-guiding mechanism 9 is accommodated. This roughly circular part opens out towards the bottom in a groove 26 in which the magazine follower 8 engages during the vertical lifting phase. This roughly circular part also opens out in a second groove 27 at 90° from the previous groove in which the magazine follower 8 engages during its movement phase towards the barrel 5.

The magazine follower 8 is released from these grooves 26, 27 between the phases described above to enable the rotation by 90° of the transport-guiding mechanism 9.

The operation of the feed device described hereabove will now be explained with reference to FIGS. 11 to 15.

On opening, the breech 3 recoils under the effect of the firing of the round, and rotates, by means of its ramp 11 in the form of an inverted "S" the levers 6, 7 which drive the feed mechanism.

The ammunition feed is carried out in three successive phases:

Phase 1 (see FIG. 12): Vertical translation of the round 2 over a distance "a".

Pushed by the magazine follower 8, the round 2 is extracted from the magazine and is engaged in the chute 10 of the transport-guiding mechanism 9. The transport-guiding mechanism 9 is immobilized in rotation, blocked by the magazine follower 8 stopped by the groove 26 of the feeder box 14.

Phase 2 (see FIG. 13): Rotation by 90° of the round 2.

The magazine follower 8 no longer stopped by the indentation 26 of the feeder box 14, the transport-guiding mechanism 9/magazine follower 8/round 2 assembly is released and rotates, enabling the round 2 to be positioned in the axis of the barrel 5.

The round 2 is held immobile between the chute 10 of the transport-guiding mechanism 9 and the magazine follower 8.

Phase 3 (see FIG. 14): Horizontal translation of the round 2 over a distance "b".

Pushed by the magazine follower 8, the round 2 is released from the chute 10 of the transport-guiding mechanism and is introduced into the barrel 5. The transport-guiding mechanism 9 is once again immobilized in rotation, blocked by the magazine follower stopped in the groove 27 of the feeder box 14.

On closing, the breech 3, brought to its forward position, drives the opposite movement of the elements of the feed mechanism which return to their starting position.

A retaining device for the ammunition column of the magazine, retractable upon return of the feed mechanism, avoids mechanical interference (impact) between the magazine follower and the following rounds of the magazine.

Naturally the invention is not limited to the example which has just been described and numerous modifications may be made without leaving the scope of the invention.

I claim:

1. A mechanism for feeding ammunition in a small arm, the small arm having a barrel having a barrel axis, a breech that moves under recoil of the small arm and a magazine configured to hold at least one round of ammunition, the magazine extending approximately parallel to the barrel axis, said mechanism comprising:

a linkage connected to the breech movable to transport the round from the magazine in a direction parallel to the longitudinal axis of the round and approximately perpendicular to the barrel axis;

a rotating member connected to said linkage rotatable to rotate the round by approximately 90° such that the round is substantially aligned with the barrel axis; and a magazine follower shaped to receive the round and to rotate with and translate along said rotating member to insert at least a portion of the round in the barrel.

2. The mechanism of claim 1, wherein said linkage includes a first lever having a finger and said breech includes a groove shaped to slidingly receive said finger, said groove having a first part extending from a rear of the breech approximately parallel to a breech movement direction, a sloped second part and a third part extending towards a front of the breech approximately parallel to the breech movement direction.

3. The mechanism of claim 2, wherein said linkage includes a second lever, said second lever being connected to said magazine follower, to said rotating member and to said first lever, said first lever being further connected to a first stationary point on said firearm.

4. The mechanism of claim 3, wherein said rotating member is substantially plate-like and approximately circular, and wherein said rotating member is disposed to rotate about a second stationary point within an approximately circular recess in the firearm.

5. The mechanism of claim 4, wherein said magazine follower includes a groove engagement part and a heel engageable under an end of the round, and wherein said rotating member includes a chute shaped to receive the round and a groove shaped to receive said groove engagement part of said magazine follower.

6. The mechanism of claim 3, wherein said first lever includes an arched portion and said second lever includes a substantially straight portion, and wherein said first lever extends above said second lever in a starting position.

7. The mechanism of claim 6, wherein a first connection between said first lever and said second lever and a second connection between said second lever and said magazine follower include pivots movable within slots in said second lever such that said second lever is movable in translation relative to said pivots within said slots.

8. The mechanism of claim 5, further comprising a first stop and a second stop, said first stop preventing said rotating member from rotating while said magazine follower moves the round from the magazine to the rotating member, said second step preventing the rotating member from rotating while said magazine follower inserts the round into the barrel.

9. The mechanism of claim 8, wherein said first stop and said second stop are attached to said firearm adjacent said recess.

10. The mechanism of claim 9, wherein the firearm includes a first groove and a second groove each shaped to receive said magazine follower and formed in communication with the recess, said first groove being approximately parallel to the barrel axis and the second groove extending approximately perpendicular to the first groove.

11. A mechanism for feeding ammunition in a small arm, the small arm having a barrel having a barrel axis, a breech that moves under recoil of the small arm and a magazine configured to hold at least one round of ammunition, the magazine extending approximately parallel to the barrel axis, said mechanism comprising:

moving means for moving the round from the magazine in a direction approximately perpendicular to the barrel axis;

rotating means for rotating the round by approximately 90° such that the round is substantially aligned with the barrel axis, said rotating means being coupled to said moving means; and inserting means for inserting at least a portion of the round into the barrel, said inserting means being coupled to said moving means and said rotating means.

12. The mechanism of claim 1 wherein said moving means includes a groove formed in the breech and a finger that engages said groove, said groove having a first part extending from a rear of the breech approximately parallel to a breech movement direction, a sloped second part and a third part extending towards a front of the breech approximately parallel to the breech movement directions.

13. The mechanism of claim 12, wherein said moving means includes a first lever and a second lever and said rotating means includes a rotating component disposed to rotate about a first fixed point on the firearm, and wherein said first lever is movably connected to said finger and disposed to pivot about a second fixed point on the firearm, said second lever is movably connected to said first lever, said rotating component, and said inserting means.

14. The mechanism of claim 13, wherein said insertion means includes a magazine follower disposed to rotate with and translate along a groove in said rotating component, said magazine follower being shaped to receive the round.

15. A method of feeding ammunition in a small arm with a feeding mechanism having a rotating member and a magazine follower connected to and disposed to rotate with the rotating member, the small arm having a barrel having a barrel axis and a magazine configured to hold at least one round of ammunition, the magazine extending approximately parallel to the barrel axis, said method comprising:

moving the round from the magazine in a direction approximately perpendicular to the barrel axis;

rotating the round by approximately 90° with the rotating member and the magazine follower such that the round is substantially aligned with the barrel axis; and inserting at least a portion of the round into the barrel with the magazine follower.

16. The method of claim 15, wherein the step of inserting includes holding the round with at least the rotating member, further comprising releasing the round from the rotating member after the portion of the round is inserted in the barrel.

17. The method of claim 15, wherein said step of inserting includes moving the round in translation.

18. The method of claim 17, wherein said step of moving the round in translation during insertion includes constraining the round to move parallel to the longitudinal axis of the round.

19. The method of claim 15, wherein said step of rotating includes rotating the round about an axis that is approximately perpendicular to the longitudinal axis of the round.

20. The method of claim 17, wherein said step of moving the round from the magazine includes constraining said round to move in translation parallel to the longitudinal axis of the round.

* * * * *